US007107788B2

(12) United States Patent
Patel et al.

(10) Patent No.: US 7,107,788 B2
(45) Date of Patent: Sep. 19, 2006

(54) RESIDUE RECYCLE-HIGH ETHANE RECOVERY PROCESS

(75) Inventors: Sanjiv Patel, Sugar Land, TX (US); Jorge H. Foglietta, Missouri City, TX (US)

(73) Assignee: ABB Lummus Global, Randall Gas Technologies, Houston, TX (US)

( * ) Notice: Subject to any disclaimer, the term of this patent is extended or adjusted under 35 U.S.C. 154(b) by 369 days.

(21) Appl. No.: 10/791,089

(22) Filed: Mar. 2, 2004

(65) Prior Publication Data

US 2004/0172967 A1 Sep. 9, 2004

Related U.S. Application Data

(60) Provisional application No. 60/453,072, filed on Mar. 7, 2003.

(51) Int. Cl.
*F25J 3/00* (2006.01)

(52) U.S. Cl. ..... 62/625; 62/632

(58) Field of Classification Search ..... 62/620, 62/625, 632, 630
See application file for complete search history.

(56) References Cited

U.S. PATENT DOCUMENTS 3,477,946 A * 11/1969 Borst, Jr. ..... 208/344
4,251,249 A 2/1981 Gulsby
4,453,958 A 6/1984 Gulsby et al.
4,592,588 A 6/1986 Isono et al.
4,592,766 A 6/1986 Kumman et al.
4,596,588 A 6/1986 Cook
4,599,096 A * 7/1986 Burr ..... 62/624
4,851,020 A 7/1989 Montgomery, IV
4,869,740 A 9/1989 Campbell et al.
4,881,960 A * 11/1989 Ranke et al. ..... 62/632
4,889,545 A 12/1989 Campbell et al.
4,895,584 A 1/1990 Buck et al.
5,275,005 A 1/1994 Campbell et al.
5,555,748 A 9/1996 Campbell et al.
5,568,737 A 10/1996 Campbell et al.
5,881,569 A 3/1999 Campbell et al.
5,890,378 A 4/1999 Rambo et al.
5,983,664 A 11/1999 Campbell et al.
6,109,061 A 8/2000 Gaskin
6,182,469 B1 2/2001 Campbell et al.
6,453,698 B1 9/2002 Jain et al.
6,712,880 B1 * 3/2004 Foglietta et al. ..... 95/184

FOREIGN PATENT DOCUMENTS

WO WO 99/23428 A 5/1999

* cited by examiner

*Primary Examiner*—William C. Doerrler
(74) *Attorney, Agent, or Firm*—Bracewell & Giuliani LLP

(57) ABSTRACT

A process and apparatus to increase the recovery of ethane, propane, and heavier compounds from a hydrocarbon gas stream is provided. The process can be configured to recover ethane and heavier compounds or propane and heavier compounds, depending upon the market conditions. The process utilizes an additional reflux stream to the absorber column that is lean in ethane and propane compared to the deethanizer overhead. The additional reflux stream is taken as a side stream of the residue gas stream that is cooled, condensed, and then fed at the top of the absorber to enhanced C3+ recovery. The additional lean reflux stream can also be taken as a side stream of the first vapor stream from the cold separator.

21 Claims, 4 Drawing Sheets

RESIDUE RECYCLE-HIGH ETHANE RECOVERY PROCESS

RELATED APPLICATIONS

This patent application claims priority to U.S. Provisional Patent Application Ser. No. 60/453,072 filed on Mar. 7, 2003, which is incorporated by reference in its entirety.

BACKGROUND OF THE INVENTION

1. Technical Field of the Invention

The present invention relates to the recovery of ethane compounds from hydrocarbon gas streams. More particularly, the present invention relates to the recovery of ethane compounds from hydrocarbon inlet gas streams using multiple reflux streams.

2. Description of Prior Art

Many prior art processes exist for the recovery of ethane compounds from hydrocarbon inlet gas streams. An example ethane recovery process can be found in U.S. Pat. No. 5,890,377 issued to Foglietta. Residue recycle processes are capable of obtaining high ethane recoveries (in excess of 95%), while recovering essentially 100% of C3+. Such processes, though impressive in achieving high recoveries consume a lot of energy in terms of compression. In order to reduce energy consumption while still maintaining high recoveries, an additional source of reflux is required. The requirements for this reflux stream are that it should be lean in desirable components (C2+) and be available at a high pressure. Prior art schemes have identified some alternate sources of reflux. The process disclosed here has a unique way of obtaining such a reflux stream. This reflux stream is used as intermediate reflux thereby reducing flow of the main reflux stream and hence energy consumption. In this process, an inlet gas is cooled by heat exchange with other streams in the process, without first splitting the inlet gas stream. As the inlet gas stream is cooled, liquid can be condensed and separated to form a first liquid stream and a first vapor stream. The first vapor stream is expanded in a turboexpander to further cool the stream. The cooled stream is then introduced to a demethanizer column at an intermediate feed position. The first liquid portion from the separator is expanded and directed to the demethanizer at a relatively lower feed position. The overhead stream from the demethanizer is heated, and compressed to a higher pressure and then divided into a volatile gas residue fraction and a compressed recycle stream. The compressed recycle stream is cooled sufficiently to substantially condense it by contacting it with the side reboilers as a part of the demethanizer column. The compressed recycle stream is further cooled and expanded to a lower pressure and supplied to the demethanizer column at a top feed position to reflux the column. The Foglietta process described above achieves a relatively high recovery efficiency of 95% and greater for ethane and heavier compounds.

A need exists for an ethane recovery process that is capable of achieving a recovery efficiency of at least 95%, but with lower energy consumption compared to prior art processes. A need also exists for a process that can take advantage of temperature profiles within a process to reduce the amount of external energy requirements that are needed to achieve high recovery efficiencies.

SUMMARY OF INVENTION

In order to meet one or more of these goals, the present invention advantageously includes a process and apparatus for ethane recovery with a decrease in compression requirements for residue gas while maintaining a high recovery yield of ethane ("$C_2$+") compounds from a hydrocarbon inlet gas stream. The inlet gas stream is split into two streams. The first feed stream is cooled by heat exchange contact in a front-end exchanger and the second feed stream is cooled by heat exchange contact in the one or more reboilers of a fractionation tower. The fractionation tower can be a demethanizer tower or any suitable device capable of recovering ethane and heavier components at a bottom of the tower from a hydrocarbon inlet gas. The two feed streams are then directed into a cold absorber. The cold absorber preferably contains at least two packed beds, or other mass transfer zones, within the cold absorber. Mass transfer zones can include any type of device that is capable of transferring molecules from a liquid flowing down the vessel containing the mass transfer zone to a gas rising through the vessel and from the gas rising through the vessel to the liquid flowing down the vessel. Other types of mass transfer zones will be known to those skilled in the art and are to be considered within the scope of the present invention. Two separate vessels with packed beds can also be used as the cold absorber instead of having a single vessel with two packed beds. The colder stream of the two streams is introduced at the top of the cold absorber, preferably above a top or first mass transfer zone, while the warmer stream is sent to the bottom of the cold absorber, preferably below a bottom or second mass transfer zone.

The cold absorber produces an absorber overhead stream, an absorber bottoms stream, and an absorber side draw stream. The absorber bottoms stream is directed to the fractionation tower as a third fractionation tower feed stream. The absorber overhead stream is sent to an expander and then to the fractionation tower as a second fractionation tower feed stream. A residue recycle stream is also sent to the fractionation tower, preferably at a top location on the fractionation tower. The residue recycle stream is taken as a split of a residue gas stream. The residue gas stream is formed by warming and then compressing a fractionation tower overhead stream. The residue recycle stream is cooled and substantially condensed prior to being sent to the fractionation tower.

The absorber side draw stream is preferably removed from between the two mass transfer zones. The absorber side draw stream is then condensed and sent to the fractionation tower. The absorber side draw stream can be sent to the fractionation tower below the residue recycle stream as an intermediate feed stream. Alternatively, the tower side draw stream can be added to the residue recycle stream to form the first fractionation tower feed stream. The alternate embodiment is particularly effective when a lean hydrocarbon feed stream is used.

The fractionation tower also produces one or more reboiler streams and a fractionation tower bottoms stream. The reboiler streams are warmed in a reboiler and redirected back to the fractionation tower to supply heat to the fractionation tower and recover refrigeration effects from the fractionation tower. The fractionation tower bottoms stream contains the major portion of the recovered $C_2$+ compounds. The recovery of the $C_2$+ compounds is comparable to other $C_2$+ recovery processes, but the compression requirements are much lower.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE DRAWINGS

For simplification of the drawings, figure numbers are the same in the figures for various streams and equipment when the functions are the same, with respect to the streams or equipment, in each of the figures. Like numbers refer to like elements throughout, and prime, double prime, and triple prime notation, where used, generally indicate similar elements in alternative embodiments.

As used herein, the term "inlet gas" means a hydrocarbon gas, such gas is typically received from a high-pressure gas line and is substantially comprised of methane, with the balance being $C_2$ compounds, $C_3$ compounds and heavier compounds as well as carbon dioxide, nitrogen and other trace gases. The term "$C_2$ compounds" means all organic compounds having two carbon atoms, including aliphatic species such as alkanes, olefins, and alkynes, particularly, ethane, ethylene, acetylene, and the like. The term "$C_2$+ compounds" means all $C_2$ compounds and heavier compounds.

Figure 2:
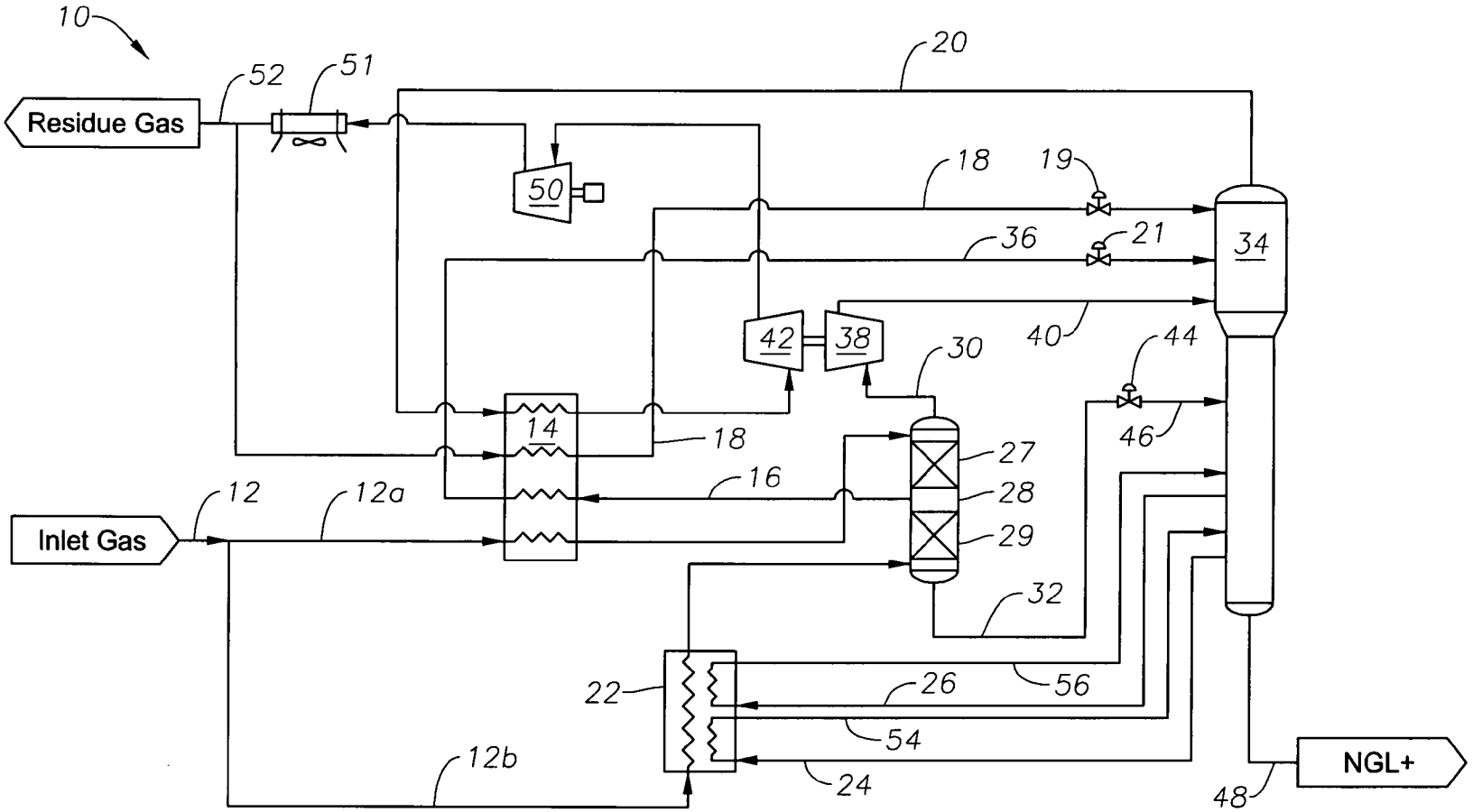
FIG. 2 is a simplified flow diagram of a $C_2$+ compound recovery process that incorporates the improvements of the present invention and is configured for reduced compression requirements while maintaining a high recovery of $C_2$+ from a hydrocarbon gas stream through the use of a side stream taken from a cold absorber and sending the stream to the fractionation tower according to an embodiment of the present invention.

FIG. 2 illustrates one embodiment of the improved $C_2$+ compound recovery scheme 10. The present invention advantageously provides a process for separating an inlet gas stream 12 containing methane, C2 components, C3 components and heavier hydrocarbons into a volatile gas fraction containing substantially all the methane and a less volatile hydrocarbon fraction containing a large portion of the C2+ components. Inlet gas stream 12 is split into a first feed stream 12*a* and a second feed stream 12*b*. A preferable split of the inlet gas stream 12 is about 70% as first feed stream 12*a* and the remainder going to second feed stream 12*b*. However, the split between first and second feed streams 12*a* and 12*b* can vary depending upon the duty available from a fractionation tower 34. Fractionation tower 34 can be a demethanizer tower or any other suitable device that can recover ethane and heavier components from the inlet gas stream. Other suitable devices will be known to those skilled in the art and are to be considered within the scope of the present invention.

Figure 4:
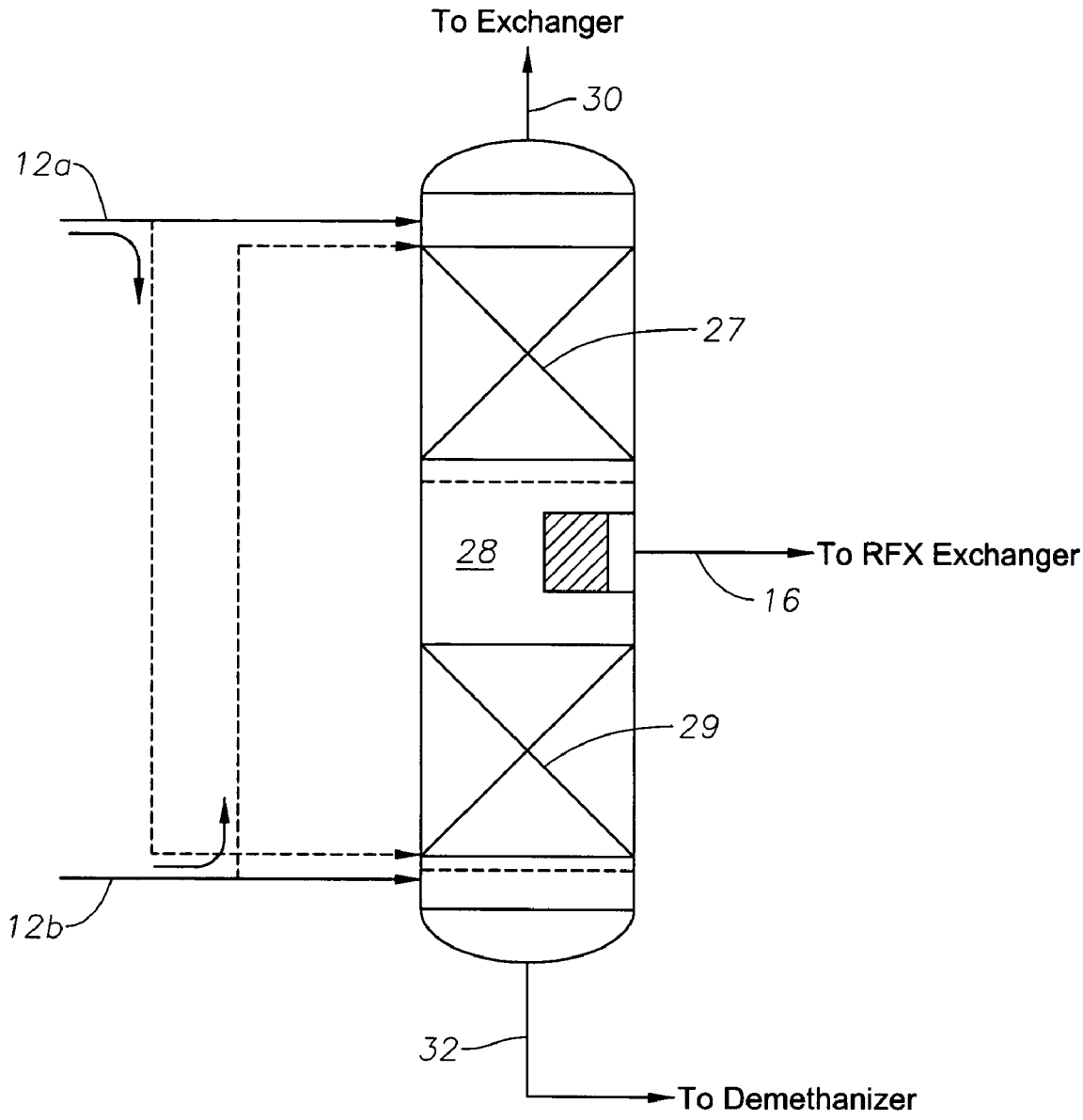
FIG. 4 is a simplified diagram illustrating an optional feed configuration for the hydrocarbon feed streams sent to a cold absorber according to an embodiment of the present invention.

First feed stream 12*a* is cooled in front end exchanger 14 preferably by heat exchange contact with at least one of an absorber side draw stream 16, a residue recycle stream 18, a fractionation tower overhead stream 20, and combinations thereof to at least partially condense first feed stream 12*a*. Second feed stream 12*b* is cooled in a fractionation tower reboiler 22 preferably by heat exchange contact with a first reboiler stream 24 and preferably a second reboiler stream 26. First feed stream 12*a* and second feed stream 12*b* can be cooled by other heat exchange contact means, as understood by those of ordinary skill in the art and are to be considered within the scope of the present invention. In all embodiments of this invention, front-end exchanger 14 and fractionation tower reboiler 22 can be a single multi-path exchanger, a plurality of individual heat exchangers, or combinations and variations thereof. First and second feed streams 12*a*, 12*b* are sent to a cold absorber 28. Cold absorber 28 preferably includes at least two packed beds, or mass transfer zones or units, 27 and 29. Two separate vessels with packed beds can also be used instead of a single vessel with both packed beds contained within. Mass transfer zones can include any type of device that is capable of transferring molecules from a liquid flowing down the vessel containing the mass transfer zone to a gas rising through the vessel and from the gas rising through the vessel to the liquid flowing down the vessel. Other types of mass transfer zones will be known to those skilled in the art and are to be considered within the scope of the present invention. As shown in FIG. 4, the colder of two feed streams 12*a*, 12*b* is sent to the top of cold absorber 28, above or before first packed bed 27, with the warmer of the two feed streams being sent to the bottom of cold absorber 28, below or after second packed bed 29. FIG. 4 shows a bypass option to allow for directing of first and second feed streams 12*a* and 12*b* to cold absorber top or bottom depending upon temperature.

Cold absorber 28, shown in FIG. 2, produces an absorber overhead stream 30, an absorber bottoms stream 32, and absorber side draw stream 16. Cold absorber 28 preferably contains at least two packed beds 27, 29, or mass transfer zones or units, within cold absorber 28. As an improvement to prior art processes, a cold absorber is used instead of a cold separator. Absorber side draw stream 16 is taken from the packed bed cold absorber 28 preferably between the two packed beds 27, 29. Tower side draw stream 16 is then substantially condensed in front end exchanger 14 and sent to fractionation tower 34 as intermediate tower feed stream 36. Because of the substantial condensation, in some embodiments, intermediate tower feed stream 36 can be substantially liquid. Intermediate tower feed stream 36 is preferably fed to fractionation tower 34 at a location below residue recycle stream 18.

Prior art processes attempted to control the temperatures of feed streams 12*a* and 12*b* to essentially be the same to minimize energy losses due to the different temperature mix. With the present invention, there can be a temperature difference between the streams of up to about 15° F. without affecting the efficiency of the process and simultaneously decreasing the compression requirements of residue gas stream 52 of the process. The colder of the two streams is sent to the top of the cold absorber 28 with the warmer of the two streams being sent to the bottom of the cold absorber 28. The mass transfer zones 27, 29 within the cold absorber 28 work with the differences in temperatures to equalize the temperatures of the two streams. The temperature of the side draw stream 16 will be in between the temperatures of top and bottom streams and the composition will be leaner than both feed streams.

To decrease the compression requirements of residue gas stream 52, intermediate tower feed stream 36 provides a secondary reflux source to supply to fractionation tower 34. The secondary reflux source allows for a reduction in the amount of material refluxed back to fractionation tower 34 in residue recycle stream 18. The less material required in residue recycle stream 18', the less material that has to be compressed in residue gas stream 52, which decreases the compression requirements for this stream. The recovery of the process remains the same as in prior art processes.

Absorber overhead stream 30 is expanded in expander 38 and sent or supplied to fractionation tower 34, preferably to a position below intermediate tower feed stream 36, as second fractionation tower feed stream 40. During the expansion, the temperature of absorber overhead stream 30 is lowered and work is produced. This work is later recovered in a booster compressor 42 driven by the expander 38 to partially boost pressure of fractionation tower overhead stream 20.

Absorber bottoms stream 32 can be expanded through expansion valve 44 or the like and is sent to fractionation tower 34 as a third fractionation tower feed stream 46. In this embodiment, fractionation tower 34 is also supplied second fractionation tower feed stream 40, residue recycle stream 18, and intermediate tower feed stream 36, thereby producing fractionation tower overhead stream 20, a fractionation tower bottoms stream 54, and reboiler bottoms streams 24 and 26.

In fractionation tower 34, desired components (C2+) in the rising are at least partially condensed by intimate contact with falling, thereby producing the fractionation tower overhead stream 20 that contains substantially all of the methane and lighter or non-condensable components. The condensed liquids descend down fractionation tower 34 and are removed as fractionation tower bottoms stream 48, which contains a major portion of the $C_2$ components and heavier components, i.e., substantially all of the C2+ components. In other words, fractionation tower 34 separates the streams that are fed to it into fractionation tower overhead stream 20 and fractionation tower bottoms stream 48.

Reboiler streams 24, 26, are preferably removed from fractionation tower 34 in the lower half of the vessel. Reboiler streams 24, 26 are warmed in reboiler 22 and returned to fractionation tower 34 as reboiler reflux streams 54 and 56. Reboiler reflux streams 54, 56 supply heat to fractionation tower 34 and recover refrigeration from fractionation tower 34.

Fractionation tower overhead stream 20 is warmed in front end exchanger 14 and compressed in booster compressor 42 and residue compressor 50 to pipeline specifications or higher to form residue gas stream 52. Residue gas stream 52 is a pipeline sales gas that contains substantially all of the methane in the inlet gas, and a minor portion of $C_2$ compounds and heavier compounds. At least a portion of residue gas stream 52 is removed and cooled in front end exchanger 14 and supplied to fractionation tower 34 as residue recycle stream 18.

Figure 3:
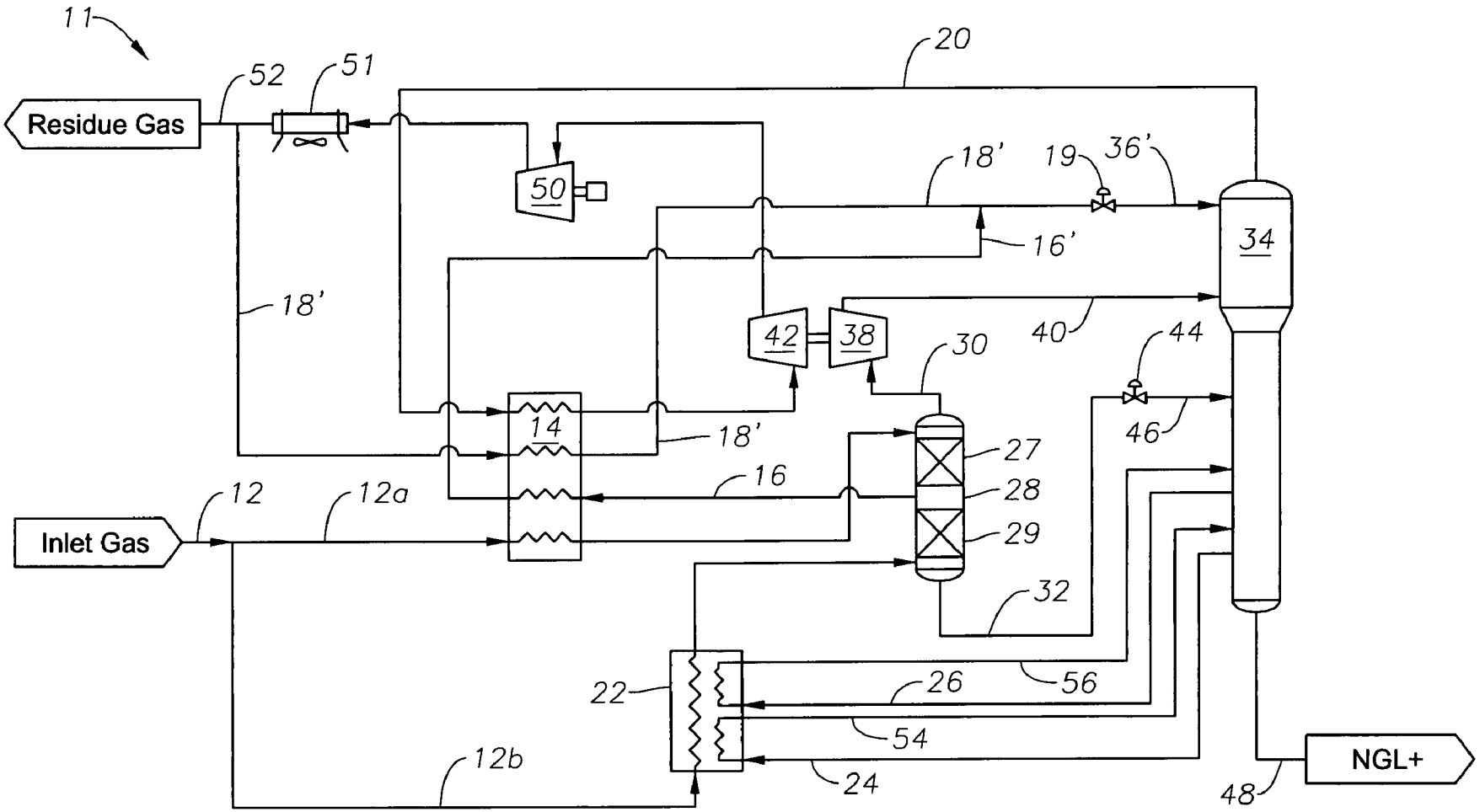
FIG. 3 is a simplified flow diagram of a $C_2$+ compound recovery process that incorporates the improvements of the present invention and is configured for reduced compression requirements while maintaining a high recovery of $C_2$+ compounds through the use of an alternate feed configuration for the cold absorber side stream to the fractionation tower according to an embodiment of the present invention.

FIG. 3 depicts an alternate embodiment of the present invention. $C_2$+ recovery process 11, includes adding absorber side draw stream 16' to residue recycle stream 18' to form first fractionation tower feed stream 36'. First fractionation tower feed stream 36' is preferably introduced to fractionation tower 34 in a top section of fractionation tower 34. The embodiment of the present invention shown in FIG. 3 is preferable when the inlet gas stream 12 is lean. When inlet gas stream 12 is lean, to maintain recovery of the desired products, more reflux is required to be sent to the top of fractionation tower 34. More reflux to fractionation tower 34 generally requires more compression of the residue gas stream to produce more residue recycle stream 18'. If absorber side draw stream 16' is added to residue recycle stream 18', less residue recycle stream 18' and less residue gas stream 52 is needed, which lowers the compression requirements of the residue gas stream 52.

Figure 1:
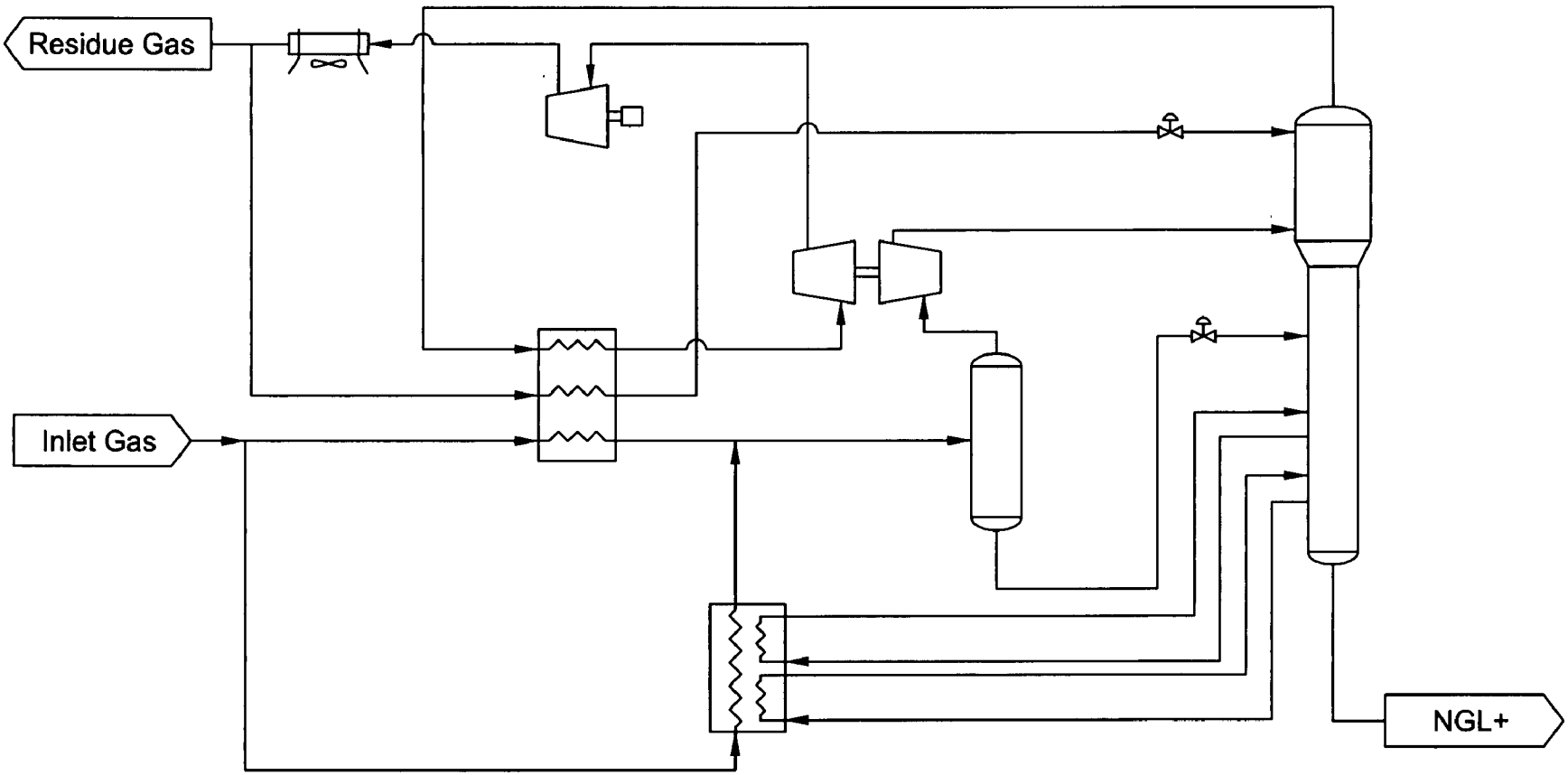
Fig. 1 (Prior Art)
FIG. 1 is a simplified flow diagram of a typical $C_2$+ compound recovery process, in accordance with a prior art process.

Simulations have been carried out to compare schemes shown in FIGS. 1 and 2. The schemes shown in the figures illustrate a single exchanger to heat and cool streams. However, the simulation model includes several heat exchangers for stream cooling and heating, which is more representative of an actual plant. Feed conditions and composition are listed below in Table 1.

TABLE 1

| Component | Mol % |
|---|---|
| Nitrogen | 0.15 |
| CO2 | 0.34 |
| Methane | 87.718 |
| Ethane | 6.821 |
| Propane | 2.733 |
| i-Butane | 0.792 |
| n-Butane | 0.641 |
| i-Pentane | 0.201 |
| n-Pentane | 0.252 |
| n-Hexane | 0.353 |
| Lbmol/hr | 100,000 |
| Temperature, ° F. | 90 |
| Pressure, psia | 800 |

TABLE 2

| Item | FIG. 1 | FIG. 2 |
|---|---|---|
| C2 Recovery, % | 95 | 95.04 |
| C3+ Recovery, % | 100 | 99.96 |
| Total Compression, hp | 56018 | 47684 |
| Total Duty, btu/h-F | 3.256E+07 | 2.944E+07 |

As can be seen in Table 2, which compares the results from simulations for FIGS. 1 and 2, the new process requires less overall compression, and lower total exchanger duty. This lower duty is mainly due to a significant decrease in residue recycle flow. The decrease in compression has two advantages. The first is lower capital cost and the second is lower operating cost. At a rate of 3.5 $/MMBtu for fuel gas, the fuel gas savings is about $2 MM per year. Although the new process requires a slightly larger cold separator, or a cold absorber, the cost of this vessel is much less than the savings in capital achieved with lower compression and required heat exchanger area. Overall, the process disclosed has lower capital and operating costs than prior art referenced.

The selection of a processing scheme between FIGS. 2 and 3 will depend on the feed composition. The compression requirement reduction will be similar in both embodiments of the present invention. Absorber side draw stream 16 provides a secondary source for reflux to fractionation tower 34, thereby reducing the amount of residue gas 52 that is being returned to fractionation tower 34. Since less residue recycle gas 18 is sent to fractionation tower 34, less residue gas stream 52 is required to be compressed, which reduces the compression requirements for the process.

In most prior $C_2$+ recovery processes, process designers attempt to make the temperatures of the split inlet feed streams the same in order to minimize energy losses due to the different temperatures of the inlet feed stream when mixed together. With the use of the packed beds, only a minimum difference in temperature is needed to achieve the same $C_2$+ recovery. This difference makes the process easy to operate, which is another advantage of the present invention. The different temperatures of the two streams are used to produce the two feeds to the cold absorber, each with a different temperature. An absorber side draw stream 16, which has a temperature between the temperatures of the first and second feed inlet gas streams, is sent to fractionation tower 34.

In addition to the process embodiments advantageously provide, the present invention also includes an apparatus embodiment for performing the processes described herein. As an embodiment of the present invention, an apparatus for separating an inlet gas stream containing methane, C2 components, C3 components and heavier hydrocarbons into a volatile gas fraction containing substantially all the methane and a less volatile hydrocarbon fraction containing a large portion of the C2+ components is advantageously provided. The apparatus preferably includes a first cooler 14, a packed bed cold absorber 28, a first expander 38, a fractionation tower 34, a first heater 14, a first compressor 42, a second cooler 14, and a third cooler 14.

First cooler, or front end cooler, 14 is preferably used for cooling a first feed stream 12*a* and a second feed stream 12*b*. Packed bed cold absorber 28 is preferably used for receiving the first feed stream 12*a* and the second feed stream 12*b* where first feed stream 12*a* has a temperature colder than second feed stream 12*b*.

Absorber 28 preferably includes at least a first and a second packed bed 27, 29 and produces an absorber overhead stream 30, an absorber bottoms stream 32, and an absorber side draw stream 16. As indicated previously, absorber side draw stream 16 is preferably removed from absorber 28 between the first and the second packed beds 27, 29.

First expander 38 preferably expands absorber overhead stream 30. During the expansion, the temperature of absorber overhead stream 30 is lowered and work is produced. This work is later recovered in a booster compressor 42 driven by the expander 38 to partially boost pressure of fractionation tower overhead stream 20.

Fractionation tower 34 separates a first fractionation tower feed stream 36, the absorber overhead stream as a second fractionation tower feed stream 40, the absorber bottoms stream as a third fractionation tower feed stream 46, and a fractionation tower reflux stream 18 to produce a fractionation tower overhead stream 20 that contains substantially all the methane and lighter components and a fractionation tower bottoms stream 48 that contains substantially all the C2+ components.

First heater 14 preferably warms the fractionation tower overhead stream. First compressor 42 compresses fractionation tower overhead stream 20 to produce a residue gas stream 52. Second cooler 14 preferably cools at least a portion of the residue gas stream 18. Third cooler 14 preferably cools and at least partially condenses absorber side draw stream 16 to form, or produce, first fractionation tower feed stream 36.

The apparatus embodiment of the present invention can also advantageously include a fourth cooler, or fractionation tower reboiler, 22 for cooling and at least partially condensing at least a portion of the inlet gas stream 12*b*. Fourth cooler 22 can also provide reboiler duty to fractionation tower 34 by providing heat exchange contact between at least a portion of the inlet gas stream 12*b* and first and second reboiler streams 24, 26.

In all embodiments of the present invention, first cooler, the second cooler, the third cooler, and the first heater can be a single heat exchanger that provides heat exchange contact between first feed stream 12*a*, absorber side draw stream 16, residue recycle stream 18, fractionation tower overhead stream 20, and combinations thereof.

The apparatus embodiments of the present invention can also include a second expander 44 for expanding at least a portion of the absorber bottoms stream prior to being sent to the fractionation tower. The apparatus embodiments can also include a third expander 19 for expanding at least a portion of the residue recycle stream prior to being sent to the fractionation tower. A fourth expander 21 can also be provided for expanding absorber side draw stream 16.

While the invention has been shown or described in only some of its forms, it should be apparent to those skilled in the art that it is not so limited, but is susceptible to various changes without departing from the scope of the invention.

For example, the expanding steps, preferably by isentropic expansion, may be effectuated with a turbo-expander, Joule-Thompson expansion valves, a liquid expander, a gas or vapor expander or the like. As another example, the packed beds within the packed bed tower can be filled with various types of packing, such as Racshig rings, Lessing rings, Berl saddles, or the like. The packed beds could also be filled with various types of trays, such as bubble cap trays, sieve trays, valve trays, and the like.

We claim:

1. A process for separating an inlet gas stream containing methane, C2 components, C3 components and heavier hydrocarbons into a volatile gas fraction containing substantially all the methane and a less volatile hydrocarbon fraction containing a large portion of the C2+ components, the process comprising the steps of:

(a) splitting an inlet gas stream into a first feed stream and a second feed stream and cooling the first and the second feed streams;

(b) supplying a top of a packed bed cold absorber with the first feed stream and a bottom of the tower with the second feed stream where the first feed stream has a temperature colder than the second feed stream, the absorber comprising at least a first and a second packed bed and producing an absorber overhead stream, an absorber bottoms stream, and an absorber side draw stream;

(c) removing the absorber side draw stream from the packed bed cold absorber;

(d) cooling and at least partially condensing the absorber side draw stream to form a first fractionation tower feed stream;

(e) expanding and then supplying a fractionation tower with the absorber overhead stream as a second fractionation tower feed stream;

(f) supplying the fractionation tower with the absorber bottoms stream as a third fractionation tower feed stream;

(g) separating the first fractionation tower feed stream, the second fractionation tower feed stream, the third fractionation tower feed stream and a tower reflux stream to produce a fractionation tower overhead stream that contains substantially all the methane and lighter components and a fractionation tower bottoms stream that contains substantially all the C2+ components;

(h) warming and compressing the fractionation tower overhead stream to produce a residue gas stream;

(i) removing at least a portion of the residue gas stream as the fractionation tower reflux stream;

(j) cooling and supplying the fractionation tower reflux stream to the fractionation tower as a residue recycle stream; and (k) supplying the fractionation tower with the first fractionation tower feed stream thereby reducing an amount of the residue gas being compressed and an amount of the residue recycle gas being sent to the fractionation tower.

2. The process of claim 1, wherein the step of removing the absorber side draw stream from the packed bed cold absorber includes removing the absorber side draw stream between the first and the second packed beds.

3. The process of claim 1, wherein the step of splitting the inlet gas stream includes splitting the inlet gas stream so that the first feed stream contains about 70% of the inlet gas stream and the second feed stream contains about 30% of the inlet gas stream.

4. The process of claim 1, wherein the step of cooling the first and second feed streams includes the steps of:

(a) cooling the first feed stream by heat exchange contact with a stream selected from the group consisting of the absorber side draw stream, the residue recycle stream, the fractionation tower overhead stream, and combinations thereof; and (b) cooling the second feed stream by heat exchange contact with a stream selected from the group consisting of a first reboiler bottoms stream, a second reboiler bottoms stream, and combinations thereof.

5. The process of claim 1, the step of cooling the absorber side draw stream so that the absorber side draw stream is substantially condensed includes cooling the absorber side draw stream so that the absorber side draw stream is essentially in liquid phase.

6. The process of claim 1, further including the step of expanding the absorber bottoms stream prior to supplying it to the fractionation tower.

7. The process of claim 1, further including the step of expanding the absorber side draw stream prior to supplying it to the fractionation tower.

8. The process of claim 1, further including the step of expanding the residue recycle stream prior to supplying it to the fractionation tower.

9. A process for separating an inlet gas stream containing methane, C2 components, C3 components and heavier hydrocarbons into a volatile gas fraction containing substantially all the methane and a less volatile hydrocarbon fraction containing a large portion of the C2+ components, the process comprising the steps of:

(a) splitting an inlet gas stream into a first feed stream and a second feed stream and cooling the first and the second feed streams;

(b) supplying a top of a packed bed cold absorber with the first feed stream and a bottom of the tower with the second feed streams where the first feed stream has a temperature colder than the second feed stream, the absorber comprising at least a first and a second packed bed and producing an absorber overhead stream, an absorber bottoms stream, and an absorber side draw stream;

(c) removing the absorber side draw stream from the packed bed cold absorber;

(d) cooling and at least partially condensing the absorber side draw stream;

(e) expanding and then supplying a fractionation tower with the absorber overhead stream as a second fractionation tower feed stream;

(f) supplying the fractionation tower with the absorber bottoms stream as a third fractionation tower feed stream;

(g) separating a first fractionation tower feed stream, the second fractionation tower feed stream, the third fractionation tower feed stream, and a fractionation tower reflux stream to produce a fractionation tower overhead stream that contains substantially all the methane and lighter components and a fractionation tower bottoms stream that contains substantially all the C2+ components;

(h) warming and compressing the fractionation tower overhead stream to produce a residue gas stream;

(i) removing at least a portion of the residue gas stream as the fractionation tower reflux stream;

(j) cooling and supplying the fractionation tower reflux stream to the fractionation tower as a residue recycle stream; and (k) adding the absorber side draw stream to the residue recycle stream to form the first fractionation tower feed stream and supplying the fractionation tower with the first fractionation tower feed stream thereby reducing an amount of the residue gas being compressed and an amount of the residue recycle gas being sent to the fractionation tower.

10. The process of claim 9, wherein the step of removing the absorber side draw stream from the packed bed cold absorber includes removing the absorber side draw stream between the first and the second packed beds.

11. The process of claim 9, wherein the step of splitting the inlet gas stream includes splitting the inlet gas stream so that the first feed stream contains about 70% of the inlet gas stream and the second feed stream contains about 30% of the inlet gas stream.

12. The process of claim 9, wherein the step of cooling the first and second feed streams includes the steps of:

(a) cooling the first feed stream by heat exchange contact with a stream selected from the group consisting of the absorber side draw stream, the residue recycle stream, the fractionation tower overhead stream, and combinations thereof; and (b) cooling the second feed stream by heat exchange contact with a stream selected from the group consisting of a first reboiler bottoms stream, a second reboiler bottoms stream, and combinations thereof.

13. The process of claim 9, the step of cooling the absorber side draw stream so that the absorber side draw stream is substantially condensed includes cooling the absorber side draw stream so that the absorber side draw stream is essentially in liquid phase.

14. The process of claim 9, further including the step of expanding the absorber bottoms stream prior to supplying it to the fractionation tower.

15. The process of claim 9, further including the step of expanding the first fractionation tower stream prior to supplying it to the fractionation tower.

16. An apparatus for separating an inlet gas stream containing methane, C2 components, C3 components and heavier hydrocarbons into a volatile gas fraction containing substantially all the methane and a less volatile hydrocarbon fraction containing a large portion of the C2+ components, the apparatus comprising:

(a) a first cooler for cooling a first feed stream and a second feed stream;

(b) a packed bed cold absorber for receiving the first feed stream and the second feed stream where the first feed stream has a temperature colder than the second feed stream, the absorber comprising at least a first and a second packed bed and producing an absorber overhead stream, an absorber bottoms stream, and an absorber side draw stream, the absorber side draw stream being removed between the first and the second packed beds;

(c) a first expander for expanding the absorber overhead stream;

(d) a fractionation tower for separating a first fractionation tower feed stream, the absorber overhead stream as a second fractionation tower feed stream, the absorber bottoms stream as a third fractionation tower feed stream, and a fractionation tower reflux stream, the fractionation tower producing a fractionation tower overhead stream that contains substantially all the methane and lighter components and a fractionation tower bottoms stream that contains substantially all the C2+ components;

(e) a first heater for warming the fractionation tower overhead stream;

(f) a first compressor for compressing the fractionation tower overhead stream to produce a residue gas stream;

(g) a second cooler for cooling the at least a portion of the residue gas stream; and (h) a third cooler for cooling and at least partially condensing the absorber side draw stream to form the first fractionation tower feed stream.

17. The apparatus of claim 16, further including a fourth cooler for cooling and at least partially condensing at least a portion of the inlet gas stream.

18. The apparatus of claim 16, wherein the first cooler, the second cooler, the third cooler, and the first heater comprise a single heat exchanger that provides heat exchange contact with each of these streams.

19. The apparatus of claim 16, further including a second expander for expanding at least a portion of the absorber bottoms stream prior to being sent to the fractionation tower.

20. The apparatus of claim 16, further including a third expander for expanding at least a portion of the residue recycle stream prior to being sent to the fractionation tower.

21. The apparatus of claim 16, further including a fourth expander for expanding at least a portion of the absorber side draw stream prior to being sent to the fractionation tower.

* * * * *